United States Patent [19]

Buckle

[11] Patent Number: 4,752,146

[45] Date of Patent: Jun. 21, 1988

[54] COLORING CRAYONS

[75] Inventor: Valerie A. Buckle, Slough, United Kingdom

[73] Assignee: The Gillette Company, Boston, Mass.

[21] Appl. No.: 363,709

[22] Filed: Mar. 30, 1982

[30] Foreign Application Priority Data

Apr. 2, 1981 [GB] United Kingdom ..... 8110347

[51] Int. Cl.[4] ..... B43K 19/00

[52] U.S. Cl. ..... 401/35; 206/303; 206/493; 294/158; 401/49; 401/88

[58] Field of Search ..... 206/303, 338, 322, 493; 401/49, 88, 35, 89; 294/158

[56] References Cited

U.S. PATENT DOCUMENTS

| | | | |
|---|---|---|---|
| 471,191 | 3/1892 | Prewitt | 401/35 |
| 533,079 | 1/1895 | Parker | 206/322 |
| 1,560,938 | 11/1925 | Lund | 206/493 X |
| 3,378,183 | 4/1968 | Ferrer | 294/158 |
| 3,694,845 | 10/1972 | Engelsher | 15/244 C |

FOREIGN PATENT DOCUMENTS

| | | | |
|---|---|---|---|
| 287326 | 11/1952 | Switzerland | 206/303 |
| 509664 | 7/1939 | United Kingdom | 401/35 |

*Primary Examiner*—Steven A. Bratlie
*Attorney, Agent, or Firm*—Scott R. Foster

[57] ABSTRACT

A set of coloring crayons comprising a number of blocks of crayon each of polygonal form with a central hole to receive a spindle on which the blocks are securely stored with the aid of releasable retaining means, such as nuts.

6 Claims, 1 Drawing Sheet

COLORING CRAYONS

FIELD OF THE INVENTION

This invention relates to coloring crayons.

SUMMARY OF THE INVENTION

Coloring crayons are conventionally formed as sticks or rods packaged in a container, for example in individual recesses in a vacuum formed tray, or in a pouch.

In accordance with the present invention, however, there is provided a set of coloring crayons comprising a plurality of blocks of crayon each having a hole through it by which the blocks can be located over a common spindle provided with releasable means for retaining the set of blocks securely on the spindle.

With this arrangement, the set can conveniently be packaged in a very simple manner, for example in a pack which can be discarded after first opening, and the crayon blocks thereafter conveniently and securely stored by remounting them on their spindle.

Preferably, the blocks are of a polygonal form presenting edges of different lengths and flat surfaces of different dimensions to permit line drawing and convenient block shading as desired. Alternatively, the set of blocks may be used on the spindle as a stick-like drawing or writing instrument, the block at either end serving as the graphic point or surface.

BRIEF DESCRIPTION OF THE DRAWING

A set of coloring crayons in accordance with the invention is described in detail below, by way of example with reference to the accompanying drawings, in which.

DESCRIPTION OF A PREFERRED EMBODIMENT

Figure 1:
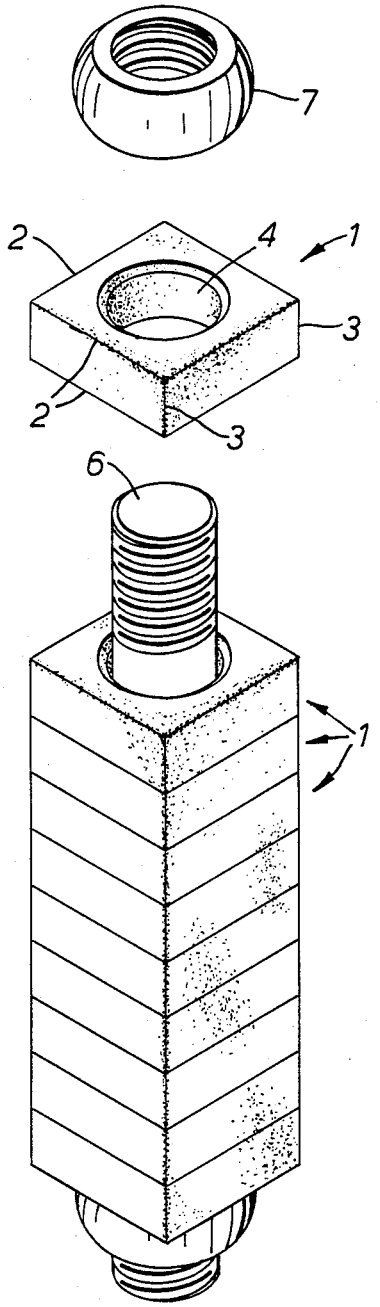
FIG. 1 is a perspective view of the set, partially dismantled.
Figure 2:
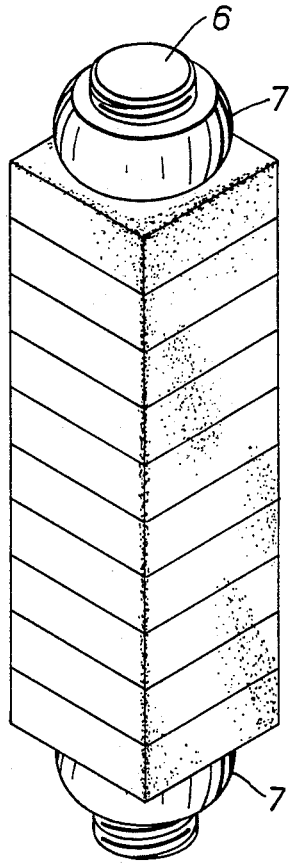
FIG. 2 is a perspective view of the set fully assembled for storage.

The set comprises a plurality of individual blocks 1 of crayon, each of polygonal form in this case of square form, whose polygonal sides 2 are of greater length than the thickness of the block as represented by the length of edges 3. The block has a central through hole 4 to facilitate gripping of the block between thumb and forefinger. All twelve edges of the block can be used for line drawing or block shading, and the flat faces of the block are also available for block shading.

In this case, ten blocks of different colors are provided and for storage are threaded over a spindle 6 to form a compact stack. The spindle is threaded at both ends to receive removable nuts 7, either or both of which can be unscrewed to permit release of the crayon blocks for individual use.

By way of example, the blocks shown may have square sides of 1.8 cm and a thickness of 0.6 cm.

Many variations will, of course, be possible within the scope of the invention. For example: other polygonal shapes may be employed, regular or irregular: the retainer on the spindle may take the form of an enlarged head, or a snap-on fixture instead of a removable nut: and of course a greater or lesser number of blocks may be provided.

I claim:

1. A set of coloring crayons comprising a spindle and a plurality of blocks of crayon each having a hole through it, said blocks being located over said spindle and retained thereon by releasable retaining means.

2. A set of coloring crayons as described in claim 1 in which said blocks are all of one shape and size.

3. A set of coloring crayons as described in claim 1 in which one of said blocks is of regular polygonal form.

4. A set of coloring crayons as described in claim 1 in which said spindle is threaded over one end portion and in which said releasable retaining means comprises a nut adapted to be received by said threaded end portion.

5. A set of coloring crayons as described in claim 1 in which said hole and said spindle are both round.

6. A set of coloring crayons comprising a round spindle which is threaded over at least one end portion thereof and a plurality of square blocks of crayon, each having a round hole through it, said blocks being located over said spindle and retained thereon by a nut adapted to be releasably received by the threaded end portion of said spindle.

* * * * *